US011527818B2

(12) United States Patent
Plugaru

(10) Patent No.: US 11,527,818 B2
(45) Date of Patent: Dec. 13, 2022

(54) ONE-HAND MOUNTING SYSTEM FOR FIXING AN ANTENNA MODULE ON A VEHICLE

(71) Applicant: Continental Automotive GmbH, Hannover (DE)

(72) Inventor: Cristian Plugaru, Munich (DE)

(73) Assignee: Continental Automotive GmbH

( * ) Notice: Subject to any disclaimer, the term of this patent is extended or adjusted under 35 U.S.C. 154(b) by 0 days.

(21) Appl. No.: 17/281,377

(22) PCT Filed: Sep. 11, 2019

(86) PCT No.: PCT/EP2019/074243
§ 371 (c)(1),
(2) Date: Mar. 30, 2021

(87) PCT Pub. No.: WO2020/069830
PCT Pub. Date: Apr. 9, 2020

(65) Prior Publication Data

US 2022/0037773 A1 Feb. 3, 2022

(30) Foreign Application Priority Data

Oct. 2, 2018 (EP) ..... 18198147

(51) Int. Cl.
*H01Q 1/32* (2006.01)
*H01Q 1/12* (2006.01)

(52) U.S. Cl.
CPC ..... *H01Q 1/3275* (2013.01); *H01Q 1/1214* (2013.01)

(58) Field of Classification Search
CPC ..... H01Q 1/3275; H01Q 1/1214
USPC ..... 434/713
See application file for complete search history.

(56) References Cited

U.S. PATENT DOCUMENTS 6,113,402 A * 9/2000 Joo ..... H01R 12/7005 439/157
6,509,878 B1 * 1/2003 Tornatta, Jr. ..... H01Q 1/3275 343/715
6,663,157 B1 * 12/2003 Hofmann ..... B60N 2/01516 297/331
6,747,603 B1 * 6/2004 Tornatta, Jr. ..... H01Q 1/3275 343/715
8,248,315 B2 * 8/2012 Lindackers ..... H01Q 1/1242 343/705

(Continued)

FOREIGN PATENT DOCUMENTS

KR 20090052711 A 5/2009

OTHER PUBLICATIONS

Extended European Search Report for European Application No. 18 198 147.3, dated Apr. 11, 2019, 9 pages.

(Continued)

*Primary Examiner* — Lam T Mai
(74) *Attorney, Agent, or Firm* — RatnerPrestia

(57) ABSTRACT

A one-hand mounting system for fixing an antenna module to a vehicle. The mounting system includes a slidable lever, which is configured to perform a translational movement, and a rotatable locking device, which is engaged with the slidable lever to transform the translational movement of the slidable lever to a rotational movement of the rotatable locking device, thereby fixing or releasing the antenna module to or from the vehicle.

13 Claims, 2 Drawing Sheets

(56) References Cited

U.S. PATENT DOCUMENTS

| | | | | |
|---|---|---|---|---|
| 2013/0113665 | A1* | 5/2013 | Burg | H01Q 1/3275<br>343/713 |
| 2016/0172746 | A1* | 6/2016 | Butscher | H01P 3/16<br>29/428 |
| 2018/0034128 | A1 | 2/2018 | Lachnitt | |
| 2020/0168982 | A1* | 5/2020 | Asuma | H01Q 1/3275 |

OTHER PUBLICATIONS

International Search Report and Written Opinion for International Application No. PCT/EP2019/074243, dated Oct. 10, 2019, 14 pages.

* cited by examiner

ONE-HAND MOUNTING SYSTEM FOR FIXING AN ANTENNA MODULE ON A VEHICLE

CROSS REFERENCE TO RELATED APPLICATIONS

This Applications is the U.S. National Phase Application of PCT International Application No. PCT/EP2019/074243, filed Sep. 11, 2019, which claims priority to European Patent Application No. 18198147.3, filed Oct. 2, 2018, the contents of such applications being incorporated by reference herein.

FIELD OF THE INVENTION

The present invention relates to the field of automotive assembly. Particularly, the invention relates to a one-hand mounting system for fixing an antenna module to a vehicle and to a vehicle comprising a one-hand mounting system.

BACKGROUND OF THE INVENTION

An antenna module, especially an intelligent antenna module, is widely implemented as a standalone telematics unit in vehicles and represents an interface between the vehicle and the outside information carriers, e.g. infrastructure (WiFi, WLAN n/ac), other cars (WLAN p), smartphones (BTLE and WiFi), cellular networks (LTE/UMTS) satellite navigation (GNSS), or radio broadcast (AM/FM). In order to mount the antenna module to the vehicle, a hole in the PCB (printed circuit board) of the antenna module may be provided to allow fastening it with screws or other tools to the vehicle.

SUMMARY OF THE INVENTION

An aspect of the invention is a simple, efficient and compact mounting solution for fixing an antenna module to a vehicle.

According to a first aspect, a one-hand mounting system for fixing an antenna module to a vehicle is provided. The system comprises a slidable lever and a rotatable locking device.

By applying the one-hand mounting system to fix or release the antenna module to or from the vehicle, the slidable lever is configured to perform a translational movement, which may be driven by pushing or pulling an open end of the slidable lever under a one-hand operation.

The rotatable locking device ist configured to be engaged with the slidable lever. The rotatable locking device is arranged in direct contact with the slidable lever. The translational movement can thus be transferred and drive further the rotatable locking device to rotate or pivot. In other words, the rotatable locking device is configured to transform or convert the translational movement of the slidable lever to the rotational movement of the rotatable locking device.

According to an embodiment, the slidable lever comprises a gear rack or at least a region of gear rack. Correspondingly, the rotatable locking device comprises a gear, which is arranged adjacent to the gear rack or the region of gear rack, so that the rotatable locking device is engaged with the gear rack of the slidable lever.

Alternatively, an increased friction between the contacting surfaces of the slidable lever and the rotatable locking device may also allow the transformation from the translational movement of the slidable lever to the rotational movement of the rotatable locking device.

According to another embodiment, the slidable lever is arranged in a cavity of a chassis of the vehicle and below a roof of the vehicle.

The cavity of the chassis, arranged below the vehicle roof, can be designed as a groove, the width of which may be defined to be identical to the width of the slidable lever. The defined width of the cavity prevents a transversal movement of the slidable lever perpendicular to the longitudinal extension of the slidable lever.

The length of the cavity may also be defined, so that the cavity is configured to stop the translational movement of the rotatable locking device and the antenna module can be tightly and appropriately fastened to the roof of the vehicle. The defined length of the slidable lever enables a reproducible and robust mounting of the antenna module.

According to another embodiment, the slidable lever further comprises a recess, which is configured to receive a rib of the chassis, and an end section, which is configured to fit in a slot of the cavity of the chassis. The slidable lever and the end section of the slidable lever are configured to generate a resistance change and a tactile feedback in turn, which may indicate the accomplished translational movement or the accomplishment of mounting the antenna module.

The resistance change may arise from the translational movement of the slidable lever to fix the antenna module. The resistance starts at a point, where the recess meets the rib of the chassis, and increases until a sudden decrease or a release, indicating that the rib of the chassis is arranged completely in the recess of the slidable lever and the end section of the slidable lever is arranged into a slot of the cavity. The resistance change may be reflected as a tactile feedback to a mounting operator, indicating clearly whether the mounting process is accomplished. This tactile feedback can significantly improve the robustness and the efficiency in mounting the antenna module.

According to another embodiment, the one-hand mounting system further comprises at least one supporting element, e.g. two supporting elements. The supporting elements are configured to mount the slidable lever to the cavity of the chassis and to prevent a movement of the slidable lever perpendicular to the longitudinal extension of the slidable lever.

According to another embodiment, the rotatable locking device is arranged in a first recess in the chassis and a second recess in the roof of the vehicle.

According to another embodiment, the rotatable locking device comprises a cylindrical body with a protrusion at a first end of the cylindrical body, which is arranged on the roof of the vehicle.

According to another embodiment, the protrusion of the rotatable locking device is configured to fix the antenna module on the vehicle.

The rotatable locking device with its protrusion is configured as the only component of the one-hand mounting system, which is arranged on the roof of the vehicle. This enables thus a compact design of the mounting system for fixing the antennal module.

According to another embodiment, the slidable lever is configured to perform the translational movement from a first position to a second position, when fixing the antenna module onto the roof. Correspondingly, the protrusion of the rotatable fixing device is configured to pivot from a third position to a fourth position.

The first position of the slidable lever is correlated with the third position of the protrusion, representing that the antenna module is not fixed to the vehicle. At the first position or the third position, the open end of the slidable lever is arranged distant from the cavity of the chassis, the rib of the chassis is not arranged in the recess of the slidable lever and the end section of the slidable lever is not arranged in the slot of the cavity. The slidable lever is flexible to move.

The second position of the slidable lever is correlated with the fourth position of the protrusion, representing that the antenna module is tightly fixed to the vehicle. At the second position or the fourth position, the open end of the slidable end is pushed to be close to the cavity of the chassis, the rib of the chassis is completely arranged in the recess of the slidable lever and the end section of the slidable lever is arranged in the slot of the cavity. The slidable lever is fixed.

The translational movement of the slidable lever from the first position to the second position can be directly transformed to the rotational movement of the rotatable locking device and further to the pivoting of the protrusion from the third position to the fourth position.

According to another embodiment, the pivoting angle of the protrusion between the third position and the fourth position is between 90° and 180°.

The maximal pivoting angle of the protrusion may be dependent on the length of the cavity or the length of the slidable lever. A smaller pivoting angle and a shorter slidable lever may result in a compacter mounting system.

According to a second aspect, a vehicle comprising a one-hand mounting system is provided.

BRIEF DESCRIPTION OF THE DRAWINGS

These and other aspects will be apparent from and elucidated with reference to the embodiments as per the drawing described hereinafter. In the following description exemplary embodiments are explained with reference to the accompanying schematic drawing in which.

DETAILED DESCRIPTION OF THE PREFERRED EMBODIMENTS

Figure 1:
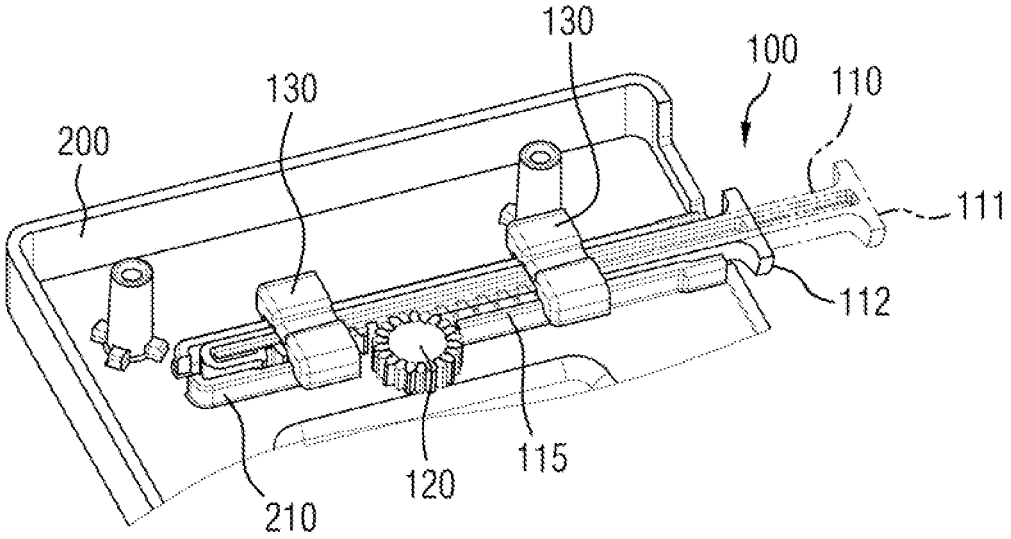
FIG. 1 shows schematically a rear view of a one-hand mounting system for fixing an antenna module to a vehicle in accordance with an embodiment.

FIG. 1 shows a rear view of a one-hand mounting system 100, which is configured to fix an antenna module to a vehicle.

The one-hand mounting system 100 comprises a slidable lever 110 having a region of gear rack 115, a rotatable locking device 120, which is arranged adjacent to the region of gear rack 115, and two supporting elements 130.

The slidable lever 110 is arranged in a cavity 210 of the chassis 200 and projects with an open end laterally into the outside of the chassis 200. The cavity 210 is designed as a groove with the width identical to the width of the slidable lever 110, as to prevent a transversal movement of the slidable lever 110 perpendicular to the longitudinal extension of the slidable lever 110. The length of the cavity 210 is shorter than the length of the slidable lever 110 and can also be defined, so that the cavity 210 can stop the translational movement of the rotatable locking device 120, when the antenna module is fixed to the vehicle.

The rotatable locking device 120 comprises a gear, which is engaged with the gear rack 115 of the slidable lever 110.

The supporting elements 130 is fixed on the cavity 210, in which the slidable lever 110 is placed inside. The slidable lever 110 is then mounted to the cavity 210 and can be prevented from moving in a direction perpendicular to the longitudinal extension of the slidable lever 110.

Furthermore, the slidable lever 110 may perform a translational movement between two positions: a first position 111 or an "off-position", in which the open end of the slidable lever 110 is arranged distant from the cavity of the chassis and the antenna module is not fixed or can be released completely from the vehicle, and a second position 112 or an "on-position" 112, in which the open end of the slidabel lever 110 is closer to the cavity 210 and the antenna module is fixed to the vehicle. When fixing the antenna module to the vehicle, the slidable lever 110 is pushed by one-hand towards the cavity 210 and performs a translational movement from the first position 111 to the second position 112.

Figure 2:
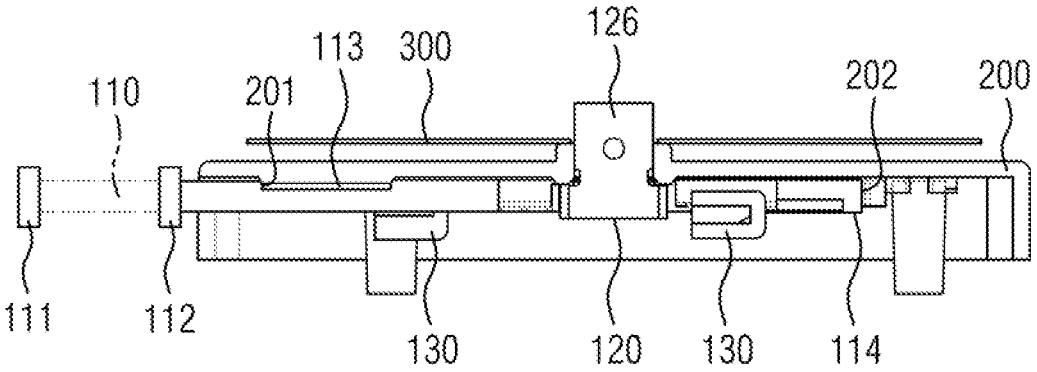
FIG. 2 shows schematically a side view of a one-hand mounting system for fixing an antenna module to a vehicle in accordance with an embodiment.

FIG. 2 shows a side view of the one-hand mounting system 100 shown in FIG. 1. It is observable that the one-hand mounting system 100 is arranged inside and under the chassis 200, which is arranged below the roof 300 of the vehicle. The slidable lever 110 further comprises a recess 113, which can receive a rib 201 of the chassis when the slidable lever 110 is pushed to the second position 112 and the antenna module is mounted.

Additionally, the slidable lever 110 further comprises an end section 114, which is configured to fit in a slot 202 of the cavity when the slidable lever 110 is pushed to the second position 112 and the antenna module is mounted.

Figure 3:
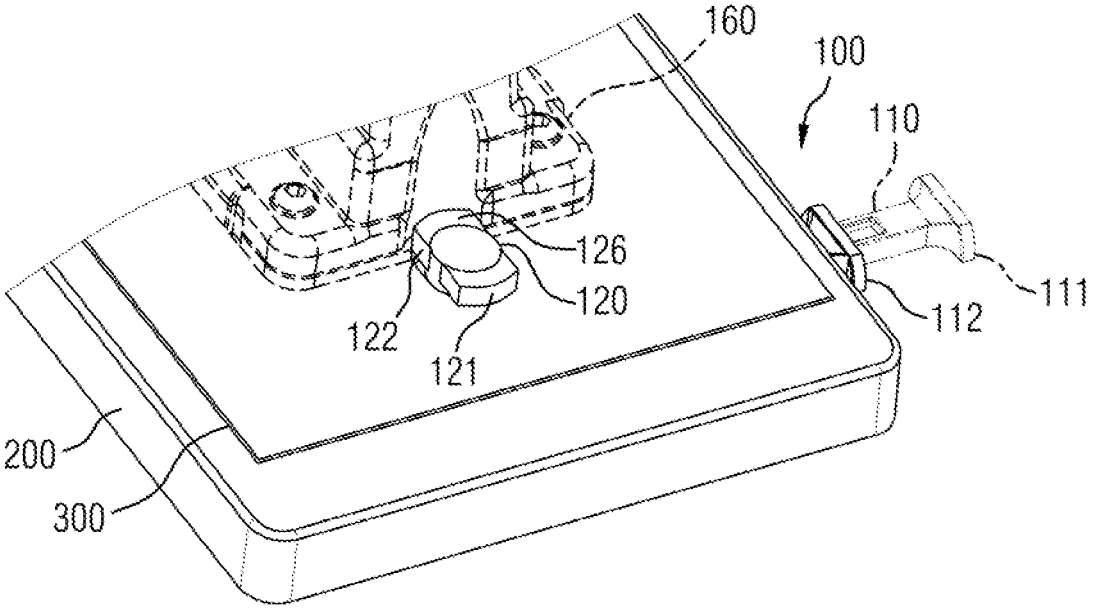
FIG. 3 shows schematically a top view of a one-hand mounting system for fixing an antenna module to a vehicle in accordance with an embodiment.

In FIG. 2, the rotatable fixing device 120 comprises a cylindrical body and a protrusion 126, which is shown in more detail in FIG. 3. With the cylindrical body, the rotatable locking device 120 is arranged in a first recess in the chassis 200 and a second recess in the roof 300 of the vehicle. Therefore, the rotatable fixing lever is the only component of the one-hand mounting system 100, which is arranged on the roof 300 of the vehicle and configured to be in direct contact with the antenna module by fixing it.

In FIG. 3, a top view of the one-hand mounting system 100 shows that an antenna module 160 can be fixed to the roof 300 of the vehicle by means of the rotatable fixing device 120, which further comprises a protrusion 126, arranged at a first end of the cylindrical body (also shown in FIG. 2) and on the roof 300 of the vehicle.

The rotatable locking device 120 has two positions, a third position 121, in which the protrusion 126 is not arranged on the antenna module 160 and the antenna module 126 is not fixed or can be released completely from the vehicle, and a fourth position 122, in which the antenna module 160 is fixed to the vehicle by means of the protrusion 126.

Since the translational movement of the slidable lever 110 can be transformed into a rotational movement of the rotatable locking device 120 via the engaged gear rack 115 and the gear, the third position 121 and the fourth position 122 of the rotatable locking device 120 are correlated, respectively, with the first position 111 and the second position 112 of the slidable lever 100. In other words, when fixing the antenna module 160, the slidable lever 110 is pushed by one-hand from the side of the chassis 200 and performs the translational movement from the first position 111 to the second position 112, resulting in the rotational movement of the rotatable locking device 120 and the pivoting of the protrusion 125 from the third position 121 to the fourth position 122 around a pivoting angle between 90° and 180°.

Figure 4:
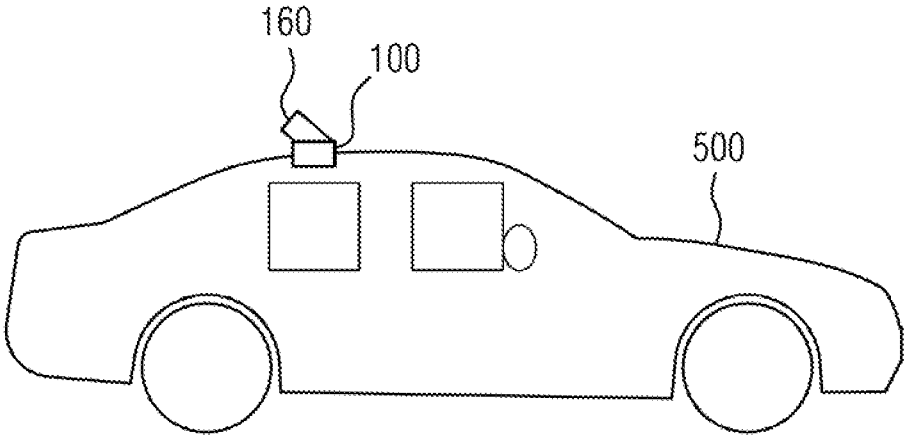
FIG. 4 shows schematically a vehicle comprising a one-hand mounting system in accordance with an embodiment.

FIG. 4 shows a vehicle 500, which comprises a one-hand mounting system 100, and an antenna module 160, which is fixed on the roof of the vehicle 500 by means of the one-hand mounting system 100.

The invention claimed is:

1. One-hand mounting system for fixing an antenna module to a vehicle, the system comprising:

a slidable lever, configured to perform a translational movement;

a rotatable locking device, engaged with the slidable lever to transform the translational movement of the slidable lever to a rotational movement of the rotatable locking device, the rotatable locking device adapted to selectively fix and release the antenna module to or from the vehicle.

2. The one-hand mounting system according to claim 1, wherein the slidable lever comprises a gear rack; and wherein the rotatable locking device comprises a gear, which is engaged with the gear rack of the slidable lever.

3. The one-hand mounting system according to claim 1, wherein the slidable lever is arranged in a cavity of a chassis of the vehicle and below a roof of the vehicle.

4. The one-hand mounting system according to claim 1, further comprising:

at least one supporting element, configured to mount the slidable lever to the cavity of the chassis and to prevent a movement of the slidable lever perpendicular to the longitudinal extension of the slidable lever.

5. The one-hand mounting system according to claim 1, wherein the rotatable locking device is arranged in a first recess in the chassis and a second recess in the roof of the vehicle.

6. The one-hand mounting system according to claim 1, wherein the rotatable locking device comprises a cylindrical body with a protrusion at a first end of the cylindrical body, which is arranged on the roof of the vehicle.

7. The one-hand mounting system according to claim 6, wherein the slidable lever is configured to perform the translational movement from a first position to a second position, when fixing the antenna module onto the roof; and wherein the protrusion of the rotatable fixing device is configured to pivot from a third position to a fourth position, when fixing the antenna module onto the roof.

8. The one-hand mounting system according to claim 7, wherein a pivoting angle between the third position and the fourth position is between 90° and 180°.

9. A vehicle comprising a one-hand mounting system according to claim 1.

10. The one-hand mounting system according to claim 2, wherein the slidable lever is arranged in a cavity of a chassis of the vehicle and below a roof of the vehicle.

11. A one-hand mounting system for fixing an antenna module to a vehicle, the system comprising:

a slidable lever, configured to perform a translational movement; and a rotatable locking device, engaged with the slidable lever to transform the translational movement of the slidable lever to a rotational movement of the rotatable locking device, thereby fixing or releasing the antenna module to or from the vehicle, wherein the slidable lever further comprises a recess, configured to receive a rib of the chassis, and an end section, configured to fit in a slot of the cavity of the chassis, and wherein the slidable lever and the end section of the slidable lever are configured to generate a tactile feedback for indicating accomplishment of mounting the antenna module.

12. A one-hand mounting system for fixing an antenna module to a vehicle, the system comprising:

a slidable lever, configured to perform a translational movement; and a rotatable locking device, engaged with the slidable lever to transform the translational movement of the slidable lever to a rotational movement of the rotatable locking device, thereby fixing or releasing the antenna module to or from the vehicle, wherein the rotatable locking device comprises a cylindrical body with a protrusion at a first end of the cylindrical body, which is arranged on the roof of the vehicle, and wherein the protrusion of the rotatable locking device is configured to fix the antenna module on the vehicle.

13. The one-hand mounting system according to claim 12, wherein the slidable lever is configured to perform the translational movement from a first position to a second position, when fixing the antenna module onto the roof; and wherein the protrusion of the rotatable fixing device is configured to pivot from a third position to a fourth position, when fixing the antenna module onto the roof.

* * * * *